United States Patent [19]

Komarov et al.

[11] 4,051,872

[45] Oct. 4, 1977

[54] TRAVELLING-WAVE LOOM

[76] Inventors: Jury Ivanovich Komarov, ulitsa Miklukho-Maklaya, 29, korpus 1, kv. 215; Viktor Mikhailovich Lukhmanov, Nagatinskaya naberezhnaya, 14, korpus 4, kv. 161; Gennady Ivanovich Kovalev, Kronshtadtsky bulvar, 27, kv. 85, all of Moscow, U.S.S.R.

[21] Appl. No.: 694,326

[22] Filed: June 9, 1976

[30] Foreign Application Priority Data

June 16, 1975 U.S.S.R. ..... 2144375

[51] Int. Cl.[2] ..... D03D 47/26; D03D 49/60

[52] U.S. Cl. ..... 139/436; 139/188 R; 139/191

[58] Field of Search ..... 139/436, 188, 190, 191

[56] References Cited

U.S. PATENT DOCUMENTS

| | | | |
|---|---|---|---|
| 3,744,532 | 7/1973 | Titov | 139/436 X |
| 3,863,680 | 2/1975 | Titov et al. | 139/436 |
| 3,896,859 | 7/1975 | Titov | 139/436 |

FOREIGN PATENT DOCUMENTS

| | | | |
|---|---|---|---|
| 208,553 | 12/1967 | U.S.S.R. | 139/436 |

*Primary Examiner*—James Kee Chi

*Attorney, Agent, or Firm*—Steinberg & Blake

[57] ABSTRACT

A travelling-wave loom relates to the machine-building branch of the textile industry. This loom comprises a cloth-forming mechanism composed of a rotary reed and a separating grate with plates, and weft thread carriers propelled through the shed of the warp threads and partially accommodated in a tunnel of the separating grate. Each carrier has a groove on the side facing the plates of the separating grate, whereas each plate of this grate has a projection engaging the groove of the carrier. The ends of the projections of the plates are positioned as close as possible to the mechanical trajectory of the crests of the teeth of the reed disks so that with the disks rotating, the teeth thereof are clear of the tops of these projections. This makes it possible to dispose the weft thread carriers, during their travel through the shed, within the zone of action of the teeth of the reed disks and the weft thread emerging from the carrier, closer to the fell of the cloth and thereby to ensure reliable engagement of this thread by the teeth of the disks and beating-up thereof to the fell of the cloth.

3 Claims, 3 Drawing Figures

TRAVELLING-WAVE LOOM

The present invention relates to the machine-building branch of the textile industry and, more particularly, it relates to travelling-ware looms.

At present, there is known a travelling-wave loom which comprises a cloth forming mechanism and weft thread carriers propelled through the shed of the warp threads. The clothforming mechanism in this loom comprises a separating grate with a tunnel wherein the weft thread carriers are partially accommodated and a rotary reed formed by a set of disks on a shaft. Each disk has teeth for propelling the carriers and for beating up the weft thread to the fell of the cloth. The disks of the reed are turned relative to one another so that the teeth thereof prove to be disposed along helical lines. Therewith, the teeth of the disks differ in length, the latter increasing in the direction of beating-up of the weft thread.

The separating grate is made up of plates adapted to separate the warp threads and to uniformly distribute them among the reed disks.

However, in this loom, the mutual arrangement of the cloth-forming mechanism and the weft thread carrier is selected so that when the carrier is flying through the shed of the warp threads, it is out of the zone of combing, that is out of the space circumscribed by the teeth of the reed disks. In this case, the weft thread may eventually be disposed out of the zone of action of the reed teeth. This may cause an entanglement. As a result, the weft thread gets intertwined with the warp threads outside the fell of the cloth when the shed makes the change. Therefore, the weft thread carrier flying through the next shed, upon having encountered the warp threads of such an entangled shed, is unable to pass along. This may result in breakage of the teeth of the reed disks cooperating with the weft thread carrier and disruption of the warp threads.

The object of the present invention is to obviate these disadvantages.

It is an object of the present invention to provide a travelling-wave loom wherein the mutual arrangement of the cloth-forming mechanism and the weft thread carriers will provide for the weft threads emerging from the carriers being as close to the fell of the cloth as possible.

Another object of the present invention is to provide a travelling-wave loom which will provide for reliable engagement of each weft thread emerging from the carrier by the teeth of the reed.

Still another object of the present invention is to provide a travelling-wave loom featuring high capacity and ensuring adequate quality of the cloth.

These and other objects are attained by that in a travelling-wave loom comprising a cloth-forming mechanism with a rotary reed composed of disks with teeth and a separating grate formed by plates, and a weft thread carrier flying through the shed of the warp threads partially accommodated in a tunnel of the separating grate and cooperating with one of the teeth of the disks of the rotary reed for accomplishing said flight, in accordance with the invention, in each weft thread carrier, on the side wall thereof facing the separating grate, there is made a groove, whereas each of the plates of this grate has a projection on the side facing the carrier engaging the groove of the carrier, the end of the projection being located as close as possible to the mechanical trajectory of the crest of the teeth of the disks so that with the disks rotating the teeth thereof are clear of the projections of the plates.

The invention is further characterized in that each projection on the plates of the grate is disposed level with the shed line and serves as a support for the carrier, the surface of the projection whereon the carriers rest being located above the shed line.

Such an embodiment of the carrier and plates of the separating grate makes it possible to dispose the weft thread carrier in the zone of action of the teeth of the reed disk, and the weft thread emerging from the carrier, closer to the fell of the cloth, i.e. also in the zone of action of the teeth of the reed disk, due to which reliable engagement of the weft thread by the teeth of the reed disk and beating-up thereof to the fell of the cloth are ensured, whereby adequate quality of the woven cloth is ensured, too.

It is expedient that the groove in the carrier and the projection on the plates of the grate be tapered. This contributes to a rapid passage of the weft thread over the inclined sides of the projection on the plates into the zone of combing, i.e. into the zone of action of the teeth of the disks even if the weft thread for some reason or other is out of the zone of combing.

Thus, the proposed modifications in the construction of the carrier and the plates of the separating grate provide such a mutual arrangement of the cloth-forming mechanism and the carriers which ensures reliable engagement of the weft thread, adequate quality of the produced cloth and high capacity of the loom.

Given below is a detailed description of the present invention with reference to the accompanying drawings, wherein.

A travelling-wave loom comprises a cloth-forming mechanism 1 (FIG. 1) and carriers 2 of a weft thread A wound on a spool 3.

The cloth-forming mechanism 1 is made up of a rotary reed and a separating grate.

Figure 1:
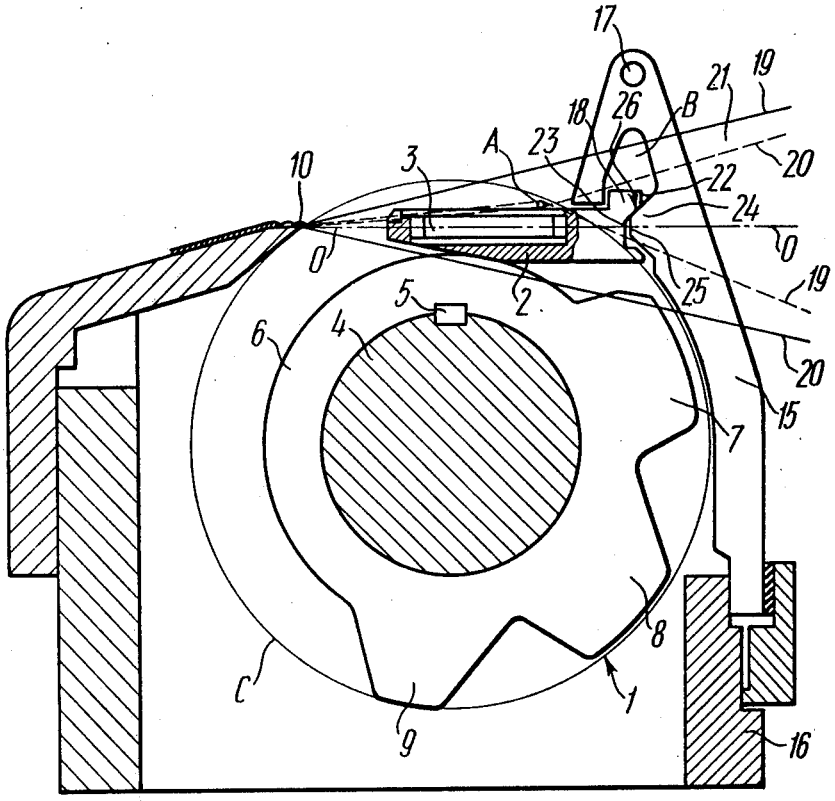
FIG. 1 is a cross-sectional view of a cloth-forming mechanism for a travelling-wave loom, according to the invention.

The rotary reed includes a shaft 4 secured whereon by means of a key 5 are disks 6, each being provided with teeth 7, 8 and 9. These teeth of the disks are adapted to beat up the weft thread A to a fell 10 (FIGS. 2 and 3) of the cloth and have different radial length, as is shown in FIG. 1.

The teeth 7, 8 and 9 are arranged so that their radial length increases in the direction of beating-up of the weft thread A.

The disks 6 are angularly offset on the shaft 4 relative to one another so that the teeth 7 of the disks 6 extend along a helicoid 11 (FIG. 2), the teeth 8 along a helicoidal surface 12 and the teeth 9 along a helicoidal surface 13.

Figure 2:
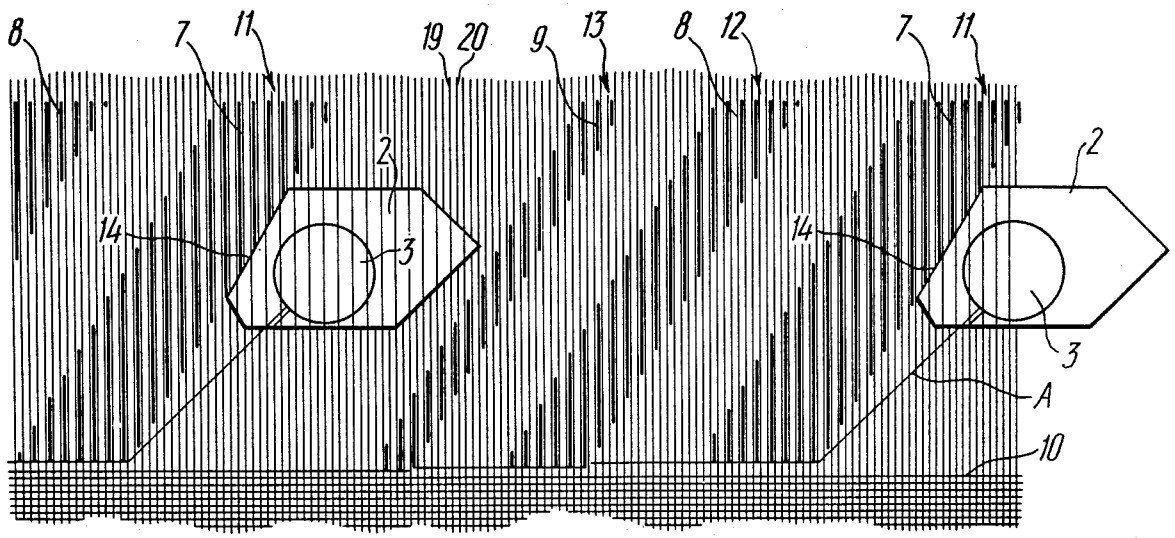
FIG. 2 shows schematically the process of advancing the weft thread and beating-up thereof to the fell of the cloth during normal process of cloth formation.

The tooth 7 (FIG. 1) of the disks 6, which is the shortest one, serves as a means for propelling the carriers 2, while cooperating with a butt end 14 of the carrier 2 as is shown in FIG. 2.

The separating grate is formed by plates 15 (FIG. 1) arranged parallel to and after one another in the plane of drawing. The plates 15 are spaced equal distances apart and are secured on a housing 16 and a rod 17 extending parallel to the shaft 4.

In each plate 15, there is made a recess, the recesses forming together a tunnel B in the separating grate. The tunnel B receives an abutment 18 of the weft thread carrier 2. Each plate 15 terminates on one side of the abutment 18 in a free end which is situated adjacent the top surface of the weft thread carrier 2. The plates 15 of the separating grate serve to separate warp threads 19 and 20 and to uniformly distribute them among the disks 6 of the reed when the shed 21 is being formed as well as to guide the weft thread carriers 2 during the flight thereof through the shed 21.

In accordance with the invention, made in each weft thread carrier 2, on a side wall 22 thereof facing the separating grate, is a groove 23, whereas each of the plates 15 of this grate, on the side facing the carrier, is provided with a projection 24 extending into groove 23 of the carrier.

The projection 24 and the groove 23 are tapered or have, for instance, a trapezoidal shape as is shown in FIG. 1.

Ends 25 of the projections 24 are placed as close as possible to mechanical trajectories C of the crests of the radially longest teeth 9 of the disks 6 as is shown in FIG. 1 so that with the disks 6 rotating, the teeth thereof, especially, the teeth 9 are clear of the projections 24 of the plates 15.

Besides, the projections 24 of the plates 15 are placed level with a line O—O of the shed 21 and serve as a support for the carriers. Therewith, a surface 26 of the projection 24, whereon the carrier rests, is positioned above the line O—O of the shed 21.

With the loom running, the rotating disks 6 of the reed propel the carriers 2 (FIG. 2) of the weft thread A due to the interaction of the teeth 7 of said disks with the butt ends 14 of the carriers. The carriers 2 of the weft thread, while passing along the shed 21 of the warp threads 19 and 20, leave behind the weft threads A unwound from spools 3.

The weft threads A placed in the shed 21 of the warp threads are advanced and forced by the teeth 7, 8, 9 of the disks 6 of the reed to the fell 10 of the cloth to be woven thereinto at a subsequent shedding motion.

Therewith, due to the projection 24 engaging the groove 23 of the weft thread carrier 2, the larger portion of the carrier 2 and, which is of primary importance, the entire spool 3 thereof are disposed in the zone of combing, i.e. in the zone of trajectories of the teeth 7, 8 and 9. This provides for more reliable engagement of the weft thread A by the teeth 7, 8 and 9 of the disks 6 of the reed and weaving thereof into the fell 10 of the cloth.

Figure 3:
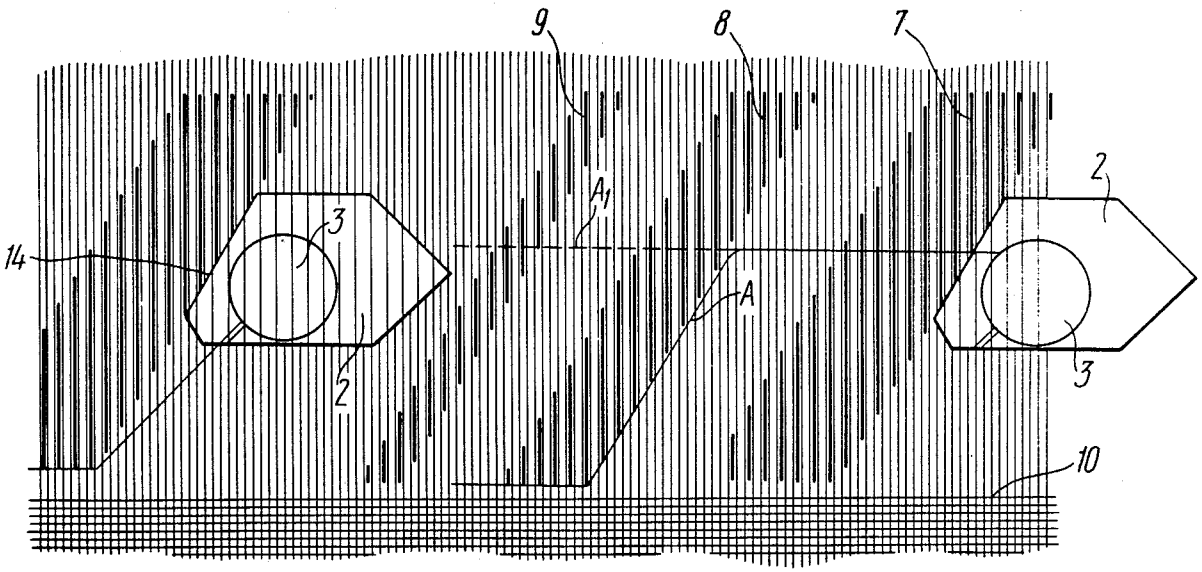
FIG. 3 shows schematically the process of engagement and transfer of an intertwined weft thread when an entanglement occurs.

If, for some reason, the weft thread A emerging from the weft thread carrier fails to be forced to the fell 10 of the cloth, it gets intertwined with the warp threads 19 and 20 and the shed shown in FIG. 1 by broken lines is a result. Since the weft thread is placed in the zone of action of the teeth 7, 8 and 9 of the disks, entanglement also occurs in this zone and the intertwined weft thread A shown in FIG. 3 by a broken line is subjected to the action of the teeth 7, 8, and 9 which advance and force it to the fell 10 of the cloth, wherein it is woven into the cloth. The moment of weaving of the intertwined weft thread A into the fell 10 of the cloth is shown in FIG. 3, the end of the intertwined thread forced to the fell being shown by a solid line.

What is claimed is:

1. A travelling-wave loom comprising: a cloth-forming mechanism composed of a rotary reed and a separating grate; disks with teeth forming the rotary reed of said cloth-forming mechanism, the crests thereof tracing out a trajectory with the disks rotating; plates forming a separating grate of said cloth-forming mechanism and having recesses forming a tunnel of the separating grate; weft thread carriers flying through the shed of the warp threads, each of the carriers having an abutment extending into said tunnel for partially accommodating each carrier in the tunnel of the separating grate and each carrier being provided with a side wall facing the plates of said separating grate, the latter plates respectively terminating on one side of the abutment of each carrier in a free end situated adjacent a top surface of each carrier, said carriers cooperating with one of the teeth of the disks of the rotary reed for accomplishing said flight through the shed; a groove being formed in each of said weft thread-carriers on the side wall thereof facing said plates of the separating grate; a projection on each of said plates of the separating grate engaging said groove of said weft thread carriers and having an end disposed as close as possible to the trajectories circumscribed by the crests of the teeth of said disks of the rotary reed so that with the disks rotating the teeth thereof are clear of said projections of the plates.

2. A loom as claimed in claim 1, wherein each projection of the plates of the separating grate is placed level with the shed line and serves as a support for the weft thread carriers, the surface of the projection whereon the carriers rest being located above the shed line.

3. A loom as claimed in claim 1, wherein the groove in the carriers and the projection of the plates of the separating grate are tapered.

* * * * *